US011849872B2

(12) United States Patent
Garcia

(10) Patent No.: US 11,849,872 B2
(45) Date of Patent: Dec. 26, 2023

(54) COLLAPSIBLE FOOD CONTAINER SUPPORTING ASSEMBLY AND METHOD

(71) Applicant: Tino Garcia, Englewood, CO (US)

(72) Inventor: Tino Garcia, Englewood, CO (US)

( * ) Notice: Subject to any disclaimer, the term of this patent is extended or adjusted under 35 U.S.C. 154(b) by 0 days.

(21) Appl. No.: 17/743,555

(22) Filed: May 13, 2022

(65) Prior Publication Data

US 2023/0363561 A1 Nov. 16, 2023

(51) Int. Cl.
*A47G 23/02* (2006.01)

(52) U.S. Cl.
CPC ..... *A47G 23/0258* (2013.01); *A47G 2200/12* (2013.01); *A47G 2400/08* (2013.01)

(58) Field of Classification Search
CPC ..... A47G 23/0258; A47G 2200/12; A47G 2400/08
See application file for complete search history.

(56) References Cited

U.S. PATENT DOCUMENTS 733,449 A * 7/1903 Willsie ..... B65B 1/22 248/97
4,921,195 A 5/1990 Clark
5,007,606 A 4/1991 Allen
5,797,567 A * 8/1998 Magnafici ..... B65B 67/1227 248/101
5,918,651 A * 7/1999 Gazdy ..... B65B 67/1277 141/391
6,176,455 B1 * 1/2001 Ma ..... B65F 1/04 248/101
7,124,990 B1 10/2006 Sanathra
7,611,102 B2 * 11/2009 Murray ..... B65B 43/465 248/101
7,814,337 B2 * 10/2010 Lee ..... G06F 21/79 713/193
8,292,239 B1 10/2012 Elden Limb
D701,125 S 3/2014 Propper
9,169,064 B2 * 10/2015 Raymond ..... B65F 1/1415
9,814,337 B2 11/2017 Lowenberg
10,017,198 B1 * 7/2018 Stamper ..... B65F 1/10
2010/0314507 A1 12/2010 Laitila
2015/0246772 A1 * 9/2015 Raymond ..... B65F 1/062 220/495.07
2016/0207666 A1 * 7/2016 Loewenberg ..... A47G 19/30
2018/0057260 A1 * 3/2018 Ramirez ..... B65F 1/1415

FOREIGN PATENT DOCUMENTS

CN 215399647 U * 1/2022
FR 2866004 A1 * 8/2005 ..... B65B 67/1233
WO WO2012060989 5/2012

* cited by examiner

*Primary Examiner* — Kimberly T Wood

(57) ABSTRACT

A collapsible food container supporting assembly includes a base having a top side and a bottom side. The base includes a first end, a second end, a first lateral edge and a second lateral edge. A bag engagement member is mounted on the base and releasably engages a bottom of an open bag. A vertical support is attached to the base and extends upwardly therefrom. The vertical support receives a side edge of the open bag to retain the side edge in a vertical orientation.

7 Claims, 5 Drawing Sheets

COLLAPSIBLE FOOD CONTAINER SUPPORTING ASSEMBLY AND METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to snack bag support device and more particularly pertains to a new snack bag support device for supporting a snack bag.

(2) Description of Related Art Including Information Disclosed Under 37 CFR 1.97 and 1.98

The prior art relates to snack bag support devices. The prior art relates to a variety of snack bag support devices having a clamp mechanism used to secure an edge of the snack bag. Known prior art lacks a snack bag support device having a clamp mechanism to secure a lower edge of a snack bag and a vertical support to position the bag in an upright position.

BRIEF SUMMARY OF THE INVENTION

An embodiment of the disclosure meets the needs presented above by generally comprising a base having a top side and a bottom side. The base includes a first end, a second end, a first lateral edge and a second lateral edge. A bag engagement member is mounted on the base and releasably engages a bottom of an open bag. A vertical support is attached to the base and extends upwardly therefrom. The vertical support receives a side edge of the open bag to retain the side edge in a vertical orientation.

In another embodiment, a method of engaging a side edge of a bag containing food with a vertical support extending upwardly from a top side of a base. The bag has a bottom edge positioned adjacent to the base. Furthermore, the method includes coupling the bottom edge to the base with a bag engagement member, wherein the bag is retained on the base and in an upright orientation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
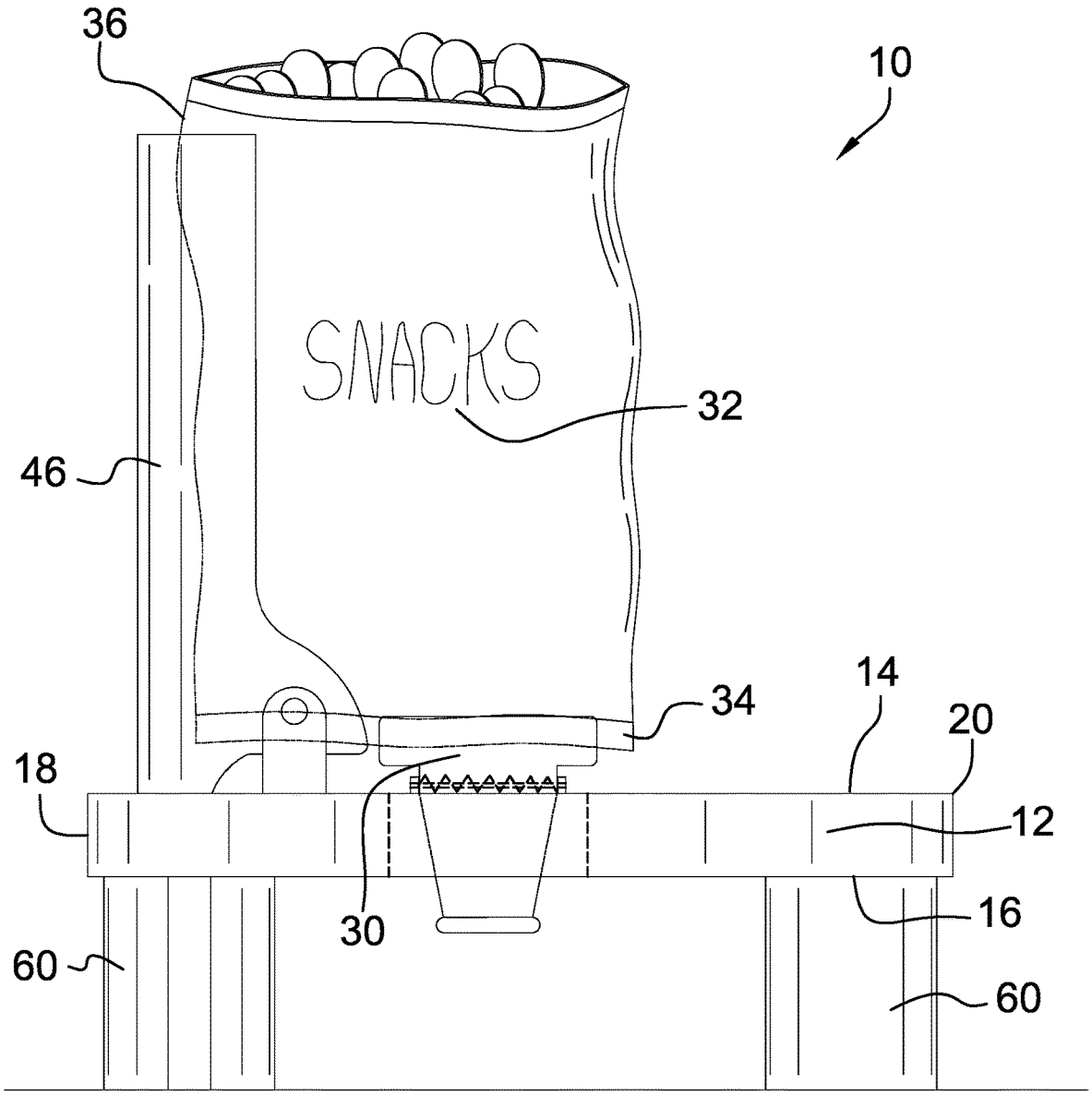
FIG. 1 is a front in-use view of a collapsible food container supporting assembly and method according to an embodiment of the disclosure.
Figure 2:
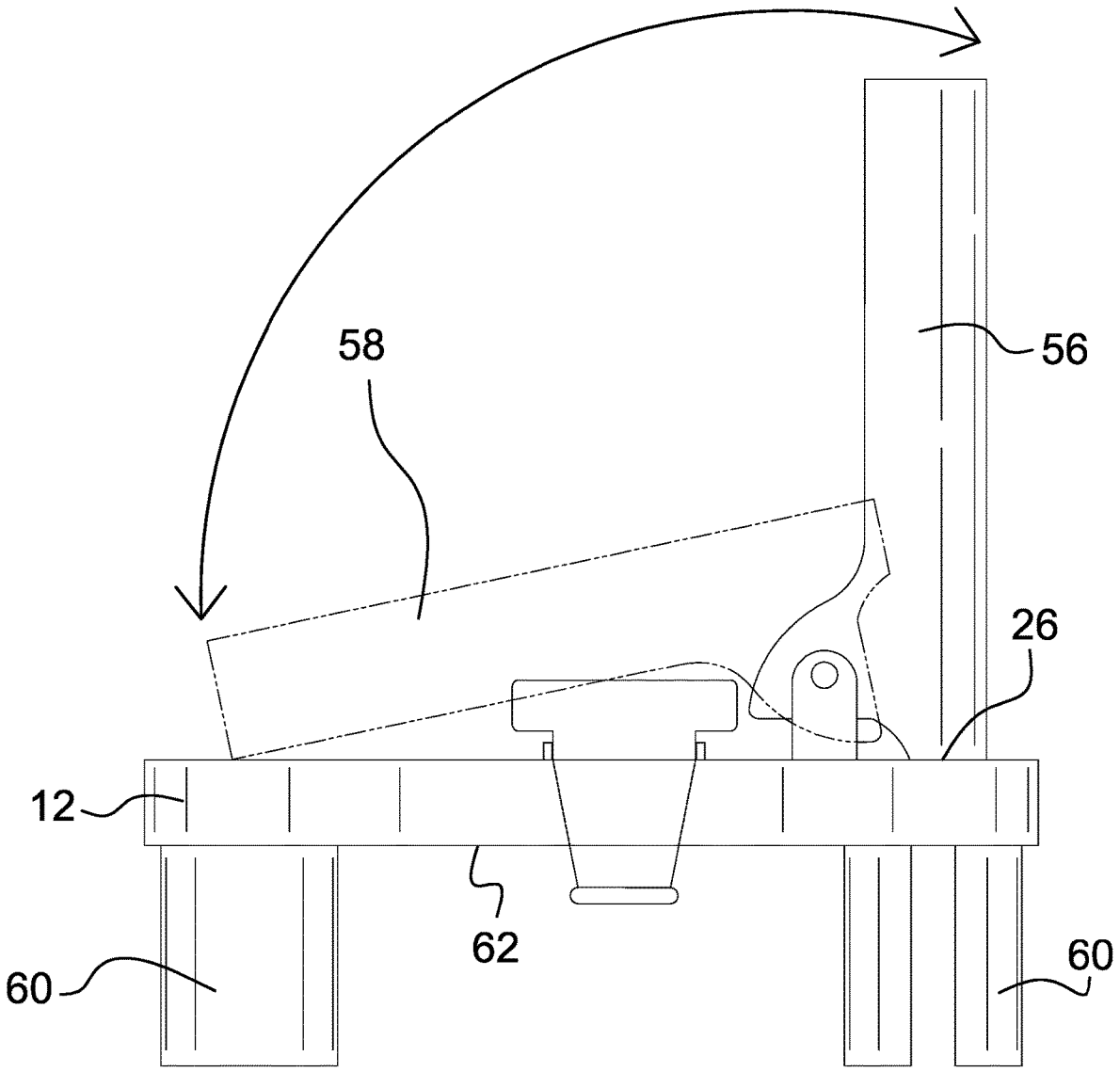
FIG. 2 is a rear view of an embodiment of the disclosure.
Figure 3:
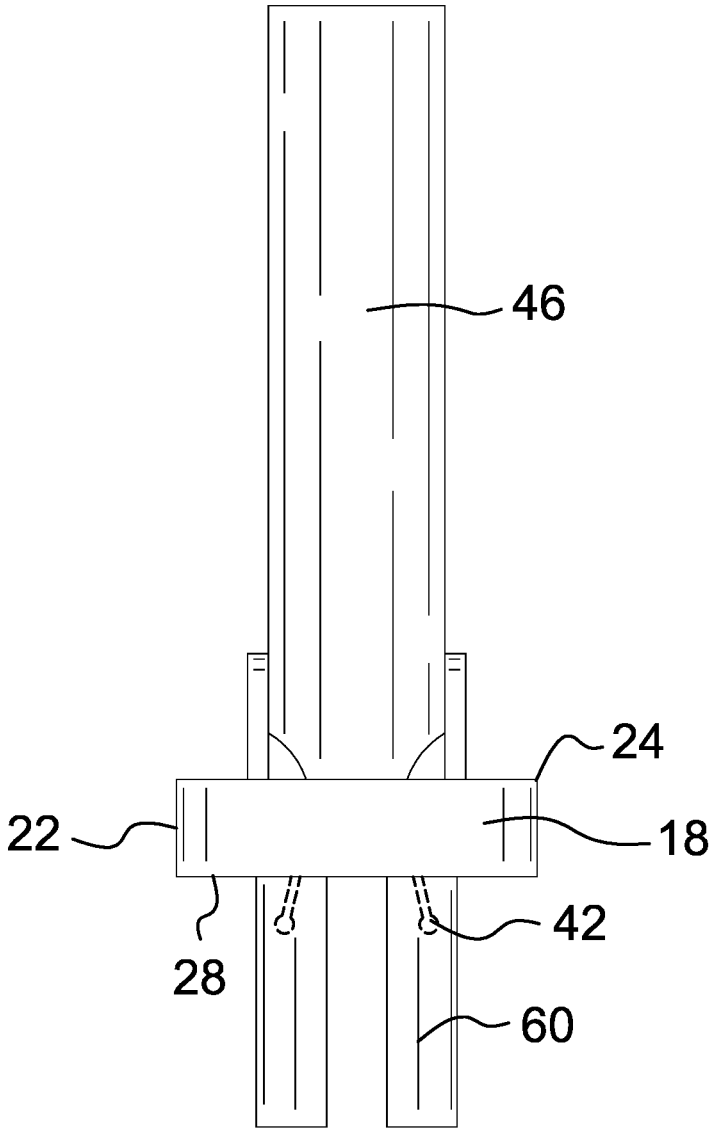
FIG. 3 is a left side view of an embodiment of the disclosure.
Figure 4:
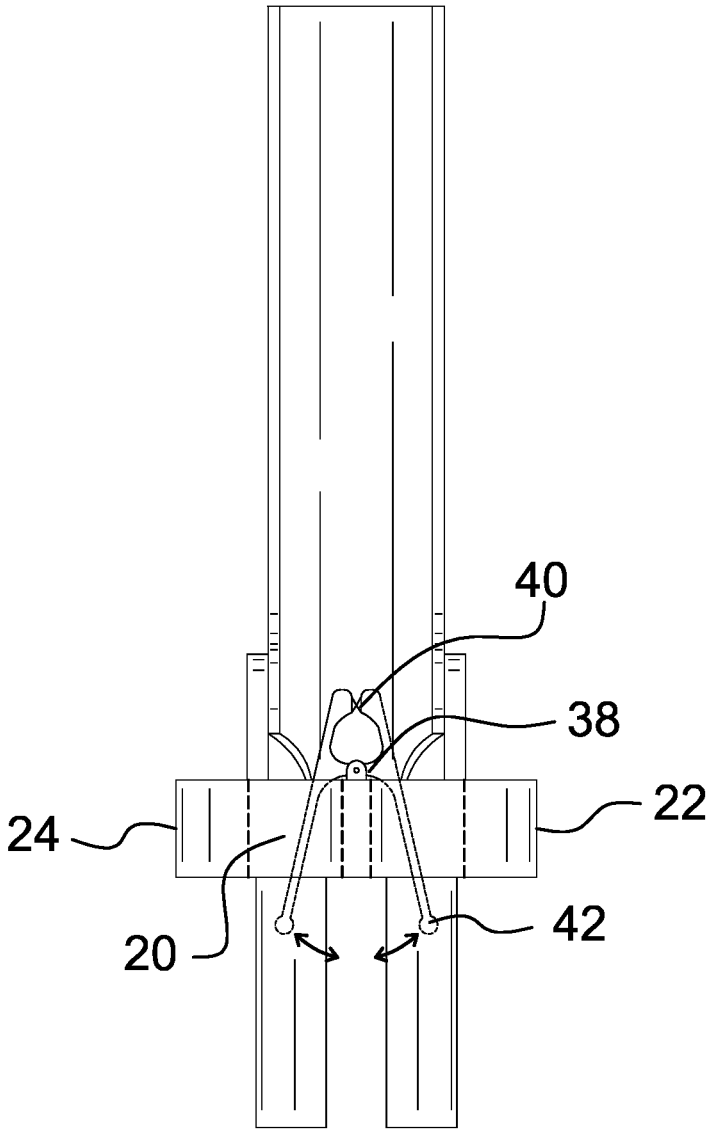
FIG. 4 is a right side view of an embodiment of the disclosure.
Figure 5:
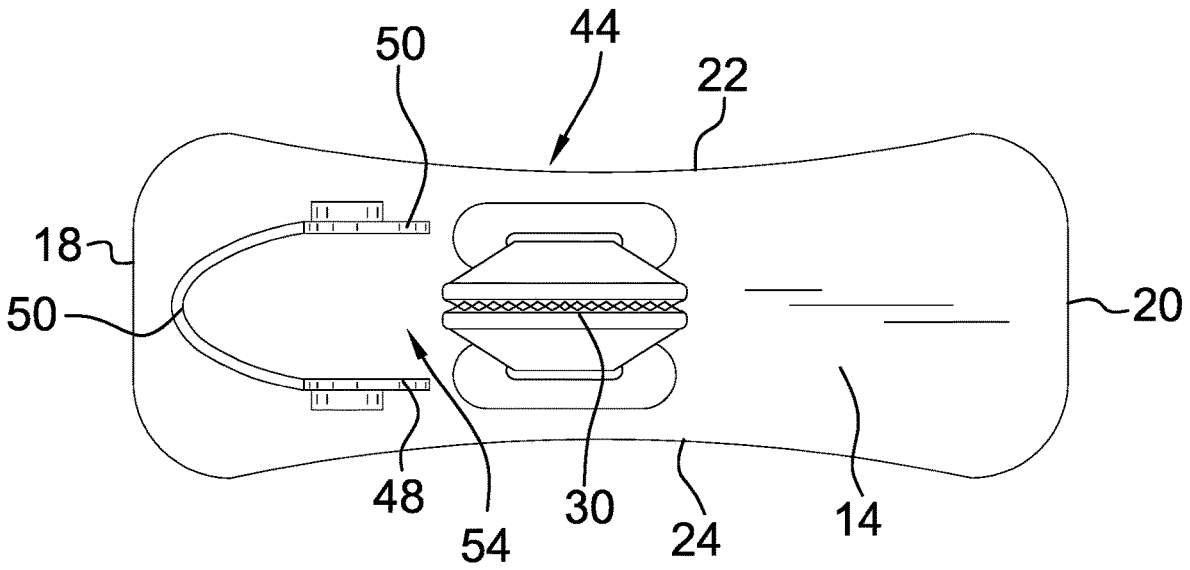
FIG. 5 is a top view of an embodiment of the disclosure.
Figure 6:
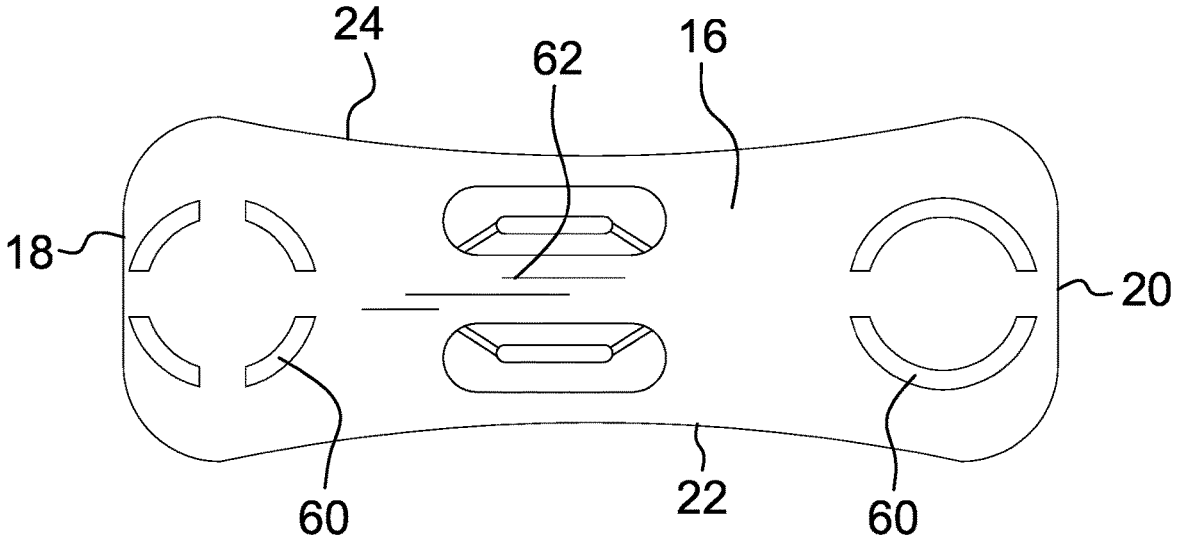
FIG. 6 is a bottom view of an embodiment of the disclosure.

With reference now to the drawings, and in particular to FIGS. 1 through 6 thereof, a new snack bag support device embodying the principles and concepts of an embodiment of the disclosure and generally designated by the reference numeral 10 will be described.

As best illustrated in FIGS. 1 through 6, the collapsible food container supporting assembly 10 and method generally comprises a base 12 having a top side 14 and a bottom side 16. The base 12 includes a first end 18 and a second end 20. Furthermore, the base 12 includes a first lateral edge 22 and a second lateral edge 24. The base 12 has a length 26 from the first end 18 to the second end 20 is from 4.0 inches to 10.0 inches. Additionally, the base 12 has a width 28 from the first lateral edge 22 to the second lateral edge 24 is from 2.0 inches to 5.0 inches.

A bag engagement member 30 is mounted on the base 12 and is configured to releasably engage a bottom 34 of the open bag 32. The bag engagement member 30 includes a clip 38. The clip 38 has a pair of jaws 40 positioned opposite of a pair of grips 42. The pair of grips 42 is actuated to open the jaws 40, yet the jaws 40 are biased toward a closed position. The jaws 40 extend upwardly from the top side 14 of the base 12. The jaws 40 are positioned in a central area 44 of the top side 14.

A vertical support 46 is attached to the base 12 and extends upwardly therefrom. The vertical support 46 is configured to receive a side edge 36 of the open bag 32 to retain the side edge 36 in a vertical orientation. The vertical support 46 includes a first side wall 48, a second side wall 50, and a back wall 52. The first side wall 48 extends upwardly from the top side 14. The second side wall 50 extends upwardly from the top side 14, and is laterally spaced from the first side wall 48. The back wall 52 is attached to and extends between the first 48 and second 50 side walls. The back wall 52 extends upwardly from the top side 14, wherein an opening 54 is defined between the first 48 and second 50 side walls and opposite of the back wall 52. The side edge 36 of the open bag 32 is extendable between the first 48 and second 50 side walls and abuttable against the back wall 52.

The first 48 and second 50 side walls may be pivotally coupled to the base 12 such that the vertical support 46 is pivotable between an upright position 56 and a stored position 58. The vertical support 46 is positioned nearer the first end 18 such that the bag engagement member 30 is positioned between the vertical support 46 and the second end 20. The back wall 52 is positioned adjacent to the first end 18. A plurality of legs 60 is attached to and extends downwardly from the bottom side 16 of the base 12. A middle area 62 of the bottom side 16 is free of the legs 60.

In use, the plurality of legs 60 is configured for being positioned on a lateral surface. Furthermore, the bottom side 16 of the base 12 can be positioned on a pair of adjacent cup holders wherein the plurality of legs 60 extends downward therefrom into the pair of adjacent cup holders to retain the base 12 in a fixed position upon the adjacent cup holders. The bottom 34 of the open bag 32 is secured within the jaws 40 of the clip 38. The side edge 36 of the open bag 32 is nested between the first 48 and second 50 side walls of the vertical support 46 to restrain the open bag 32 from leaning forward or backward. Subsequently, the open bag 32 is positioned upright and retained in a fixed position from tilting over.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A snack bag supporting assembly configured to retain an open bag in an upright position, the assembly comprising:

a base having a top side and a bottom side, the base including a first end, a second end, a first lateral edge and a second lateral edge;

a bag engagement member being mounted on the base and being configured to releasably engage a bottom of the open bag;

a vertical support being attached to the base and extending upwardly therefrom, the vertical support being configured to receive a side edge of the open bag to retain the side edge in a vertical orientation;

wherein the vertical support includes:

a first side wall extending upwardly from the top side;

a second side wall extending upwardly from the top side and being laterally spaced from the first side wall;

a back wall being attached to and extending between the first and second side walls, the back wall extending upwardly from the top side, wherein an opening is defined between the first and second side walls and opposite of the back wall;

wherein the side edge of the open bag is extendable between the first and second side walls and abuttable against the back wall; and wherein the bag engagement member includes a clip having a pair of jaws positioned opposite of a pair of grips, the pair of grips being actuated to open the jaws, the jaws being biased toward a closed position, the jaws extending upwardly from the top side of the base, the jaws being positioned in a central area of the top side.

2. The snack bag supporting assembly according to claim 1, wherein the base has a length from the first end to the second end being from 4.0 inches to 10.0 inches, the base having a width from the first lateral edge to the second lateral edge being from 2.0 inches to 5.0 inches.

3. A snack bag supporting assembly configured to retain an open bag in an upright position, the assembly comprising:

a base having a top side and a bottom side, the base including a first end, a second end, a first lateral edge and a second lateral edge;

a bag engagement member being mounted on the base and being configured to releasably engage a bottom of the open bag;

a vertical support being attached to the base and extending upwardly therefrom, the vertical support being configured to receive a side edge of the open bag to retain the side edge in a vertical orientation;

wherein the vertical support includes:

a first side wall extending upwardly from the top side;

a second side wall extending upwardly from the top side and being laterally spaced from the first side wall;

a back wall being attached to and extending between the first and second side walls, the back wall extending upwardly from the top side, wherein an opening is defined between the first and second side walls and opposite of the back wall;

wherein the side edge of the open bag is extendable between the first and second side walls and abuttable against the back wall; and wherein the first and second side walls are pivotally coupled to the base such that the vertical support is pivotable between an upright position and a stored position.

4. The snack bag supporting assembly according to claim 1, wherein the vertical support is positioned nearer the first end such that the bag engagement member is positioned between the vertical support and the second end, the back wall being positioned adjacent to the first end.

5. The snack bag supporting assembly according to claim 1, further including a plurality of legs being attached to and extending downwardly from the bottom side of the base.

6. The snack bag supporting assembly according to claim 5, wherein a middle area of the bottom side is free of the legs.

7. A snack bag supporting assembly configured to retain an open bag in an upright position, the assembly comprising:

a base having a top side and a bottom side, the base including a first end, a second end, a first lateral edge and a second lateral edge;

a bag engagement member being mounted on the base and being configured to releasably engage a bottom of the open bag, the bag engagement member including a clip having a pair of jaws positioned opposite of a pair of grips, the pair of grips being actuated to open the jaws, the jaws being biased toward a closed position, the jaws extending upwardly from the top side of the base, the jaws being positioned in a central area of the top side;

a vertical support being attached to the base and extending upwardly therefrom, the vertical support being configured to receive a side edge of the open bag to retain the side edge in a vertical orientation, the vertical support including:

a first side wall extending upwardly from the top side;

a second side wall extending upwardly from the top side and being laterally spaced from the first side wall;

a back wall being attached to and extending between the first and second side walls, the back wall extending upwardly from the top side, wherein an opening is defined between the first and second side walls and opposite of the back wall;

wherein the side edge of the open bag is extendable between the first and second side walls and abuttable against the back wall;

the vertical support being positioned nearer the first end such that the bag engagement member is positioned between the vertical support and the second end, the back wall being positioned adjacent to the first end; and a plurality of legs being attached to and extending downwardly from the bottom side of the base, a middle area of the bottom side being free of the legs.

* * * * *